US011118828B2

(12) United States Patent
Spoor et al.

(10) Patent No.: US 11,118,828 B2
(45) Date of Patent: Sep. 14, 2021

(54) COOLER WITH BARRIER

(71) Applicants: Clayton Spoor, Sunnyvale, TX (US); Ryan Robertson, Sunnyvale, TX (US)

(72) Inventors: Clayton Spoor, Sunnyvale, TX (US); Ryan Robertson, Sunnyvale, TX (US)

( * ) Notice: Subject to any disclaimer, the term of this patent is extended or adjusted under 35 U.S.C. 154(b) by 1 day.

(21) Appl. No.: 16/254,392

(22) Filed: Jan. 22, 2019

(65) Prior Publication Data

US 2020/0033044 A1 Jan. 30, 2020

Related U.S. Application Data

(60) Provisional application No. 62/703,284, filed on Jul. 25, 2018.

(51) Int. Cl.
*F25D 3/08* (2006.01)

(52) U.S. Cl.
CPC ..... *F25D 3/08* (2013.01); *F25D 2303/081* (2013.01); *F25D 2323/024* (2013.01)

(58) Field of Classification Search
CPC ..... F25D 3/08; B65D 3/268; B65D 25/54; B65D 2543/0037; B65D 15/16; B65D 2251/1016
See application file for complete search history.

(56) References Cited

U.S. PATENT DOCUMENTS

| | | | | |
|---|---|---|---|---|
| 5,212,902 | A * | 5/1993 | Moorhead | A01K 63/02 43/54.1 |
| 6,843,387 | B2 * | 1/2005 | Karaki | B65D 81/266 220/229 |
| 7,178,357 | B2 * | 2/2007 | Link | B60H 1/00264 62/440 |
| 9,423,168 | B1 * | 8/2016 | Rosso | F25D 3/08 |
| 2004/0025530 | A1 * | 2/2004 | Perrins | B60N 3/108 62/457.5 |
| 2006/0283873 | A1 * | 12/2006 | Bostic | A47K 10/32 221/33 |
| 2013/0233011 | A1 * | 9/2013 | Wolf | F25D 3/08 62/457.5 |
| 2014/0174975 | A1 * | 6/2014 | Bechyne | B65D 83/0805 206/494 |
| 2015/0175308 | A1 * | 6/2015 | Christian | F25D 3/08 220/4.01 |

* cited by examiner

*Primary Examiner* — Frantz F Jules
*Assistant Examiner* — Erik Mendoza-Wilkenfeld
(74) *Attorney, Agent, or Firm* — Braxton Perrone, PLLC; Bobby W Braxton; Gregory Perrone

(57) ABSTRACT

A system and method for a cooler with a barrier. The cooler has an internal void and a barrier located within said void. The barrier has at least one covered opening. The barrier acts as a physical barrier which prevents air from exiting the cooler. A user can retrieve contents through the covered opening. In this manner, the temperature within the cooler is maintained.

15 Claims, 6 Drawing Sheets

| Date & Time | Outside Temp (°F) | w/ IceCap (°F) | w/o IceCap (°F) |
|---|---|---|---|
| 10:00 AM | 89 | 56 | 61 |
| 10:00 AM | 89 | 56 | 65 |
| 10:00 AM | 89 | 54 | 63 |
| 10:04 AM | 89 | 54 | 61 |
| 10:30 AM | 91 | 52 | 53 |
| 10:30 AM | 91 | 53 | 59 |
| 10:33 AM | 91 | 52 | 55 |
| 10:41 AM | 91 | 52 | 53 |
| 11:00 AM | 91 | 51 | 51 |
| 11:00 AM | 91 | 51 | 58 |
| 11:00 AM | 91 | 51 | 57 |
| 11:10 AM | 91 | 51 | 51 |
| 11:30 AM | 93 | 50 | 50 |
| 11:30 AM | 93 | 55 | 71 |
| 11:32 AM | 93 | 52 | 65 |
| 11:45 AM | 93 | 52 | 54 |
| 12:00 PM | 94 | 52 | 52 |
| 12:00 PM | 94 | 55 | 66 |
| 12:10 PM | 94 | 52 | 60 |
| 12:13 PM | 94 | 52 | 54 |
| 12:30 PM | 95 | 52 | 52 |
| 12:30 PM | 95 | 56 | 65 |
| 12:34 PM | 95 | 55 | 60 |
| 12:45 PM | 95 | 55 | 56 |
| 1:00 PM | 96 | 55 | 55 |
| 1:00 PM | 96 | 57 | 64 |
| 1:03 PM | 96 | 56 | 62 |
| 1:14 PM | 96 | 56 | 58 |
| 1:30 PM | 97 | 56 | 57 |
| 1:30 PM | 97 | 60 | 71 |
| 1:34 PM | 97 | 56 | 65 |
| 1:45 PM | 97 | 55 | 58 |
| 2:00 PM | 97 | 55 | 58 |

COOLER WITH BARRIER

PRIORITY

The present invention claims priority to U.S. Application No. 62/703,284 filed Jul. 25, 2018, the entirety of which is hereby incorporated by reference.

BACKGROUND OF THE INVENTION

Technical Field

The present invention relates to a system and method for using a thermal barrier for a cooler.

Description of Related Art

Coolers are used to house and cool items. These items can include food, drinks, ice, etc. However, warm air is introduced, and cooler air released, every time a user retrieves a cooler's contents. Consequently, there is a need for a more efficient cooler.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all figures. The invention illustratively disclosed herein suitably may be practiced in the absence of any element which is not specifically disclosed herein.

Figure 1:
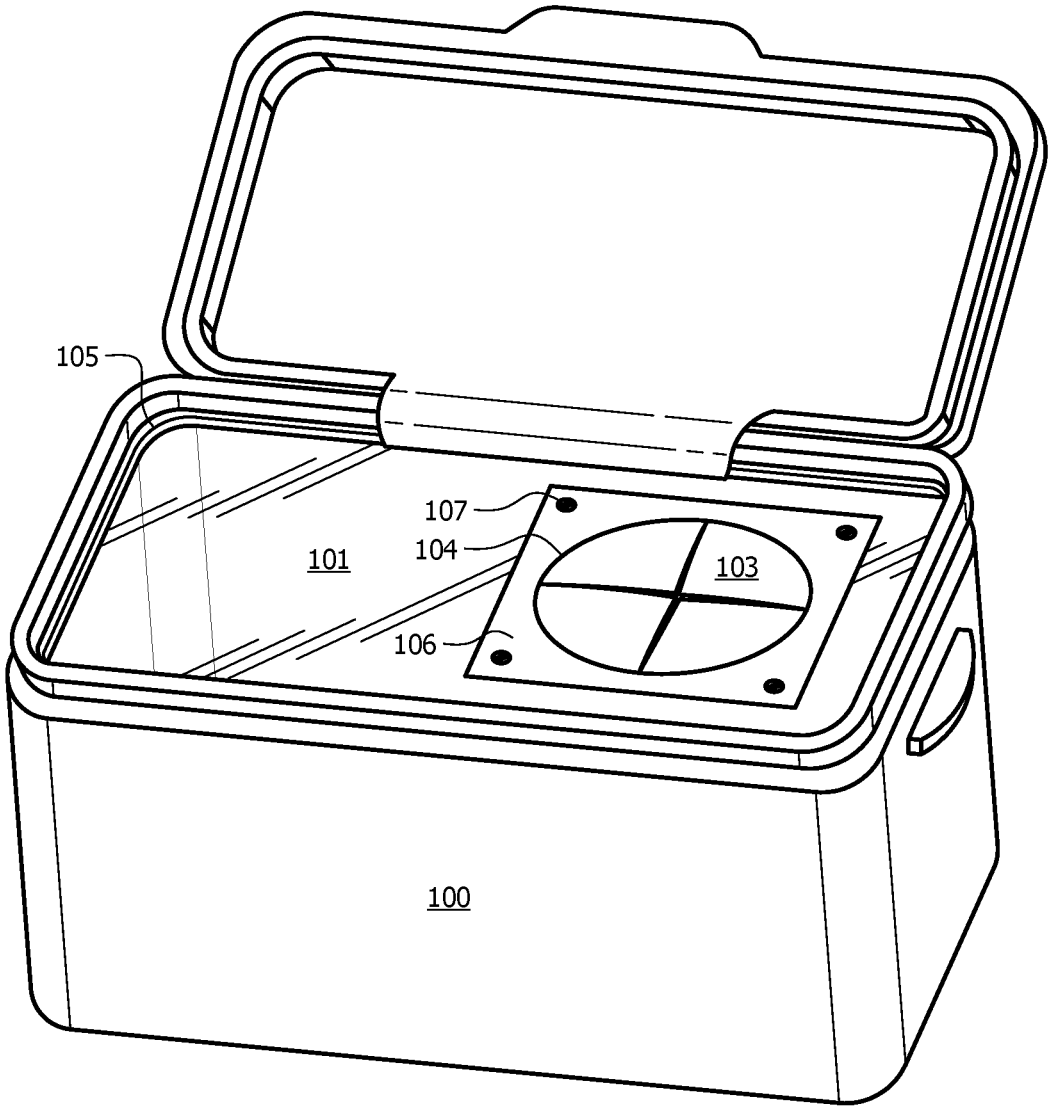
FIG. 1 is a top perspective view of a cooler in one embodiment.

FIG. 1 is a top perspective view of a cooler 100 in one embodiment. As used herein, a cooler refers to an item used to house items and keep them at a desired temperature. Virtually any coolers can be utilized. In one embodiment the cooler 100 is rectangular in shape, has a top which pivots open and closed, a front end, an opposing back end, two opposing sides, and a bottom end. In other embodiments the cooler 100 is square, and in still other embodiments the cooler comprises a circular cross-section. As can be seen, the cooler 100 can comprise virtually any shape and have virtually any size.

In one embodiment the cooler comprises a void into which the contents are stored and housed. Further, the cooler comprises an opening to place and retrieve contents. In some embodiments the opening is located on the top of the cooler for purposes of convenience.

In some embodiments, the top comprises a hinge which allows the top to pivot open and closed. In other embodiments the entire top is removable.

FIG. 1 depicts an embodiment wherein the top has been removed. Thus, in FIG. 1, the contents 102 are visible. The contents 102 can comprise virtually any item. This can include food, beverages, ice, etc. As depicted the contents 102 comprise beverage cans and ice.

While coolers are often used to keep the contents 102 cool, they are also utilized to keep contents 102 warm or hot. Thus, while an embodiment is described wherein the contents are kept cool, this is for illustrative purposes only and should not be deemed limiting.

As noted, FIG. 1 shows the contents 102 which include beverage cans and ice. When a user wants to retrieve a beverage can, for example, the user must remove the top. Typically, when this is done the cold air within the void of the cooler is released when the top is removed. The cold air in the cooler is released and replaced by warmer air. This results in the cooler void temperature increasing. This will result in ice melting, and the temperature of the contents 102 undesirably rising.

To account for this undesirable heat transfer, FIG. 1 utilizes a barrier 101. A barrier 101, as used herein, refers to a physical barrier which covers the void of the cooler. In one embodiment the barrier 101 extends to cover the entire opening of the cooler.

In operation, the barrier 101 acts to separate the temperature controlled climate in the void from the ambient temperature. Accordingly, whenever the top is opened, cool air is kept below and beneath the barrier 101. Likewise, comparatively hotter air is prevented from entering the cooler. As noted above, the inverse is true if the cooler is being used to house hot contents.

The barrier 101 can comprise virtually any material which acts as a physical barrier. The barrier 101 can comprise plastic, rubber, and combinations thereof. In one embodiment the barrier 101 comprised polycarbonate sheets. In one embodiment the barrier 101 is transparent to allow the user to see the contents through the barrier 101. In one embodiment the barrier 101 is a thermally insulting material. Thus, not only is the barrier 101 a physical barrier which prevents the passage and mixing of hot and cold air, but the barrier 101 can also thermally insulate the cooler. This further increases the effectiveness of the cooler.

In one embodiment the barrier 101 has a dual layer with air or other gas trapped between. This also provides an insulating material.

In another embodiment the barrier 101 is removeable. The barrier 101 can be removed, for example, when the cooler is being loaded with contents. In such embodiments the barrier 101 is removed to provide full and unrestricted access to the cooler void. The cooler can then be filled with beverages and ice, as an example. Thereafter, the barrier 101 is installed into its operative location.

The barrier 101 can be installed and removed via any method or device known in the art. In one embodiment the barrier 101 comprises a seal 105 along its perimeter. This seal 105 is seated along the perimeter of the cooler and provides a secure seal via friction fit. In other embodiments the barrier 101 comprise a hinge which allows the barrier 101 to rotate and pivot relative to the opening.

The barrier 101 can be integrally made at the same time as the cooler. Thus, when the consumer purchases the cooler, the barrier 101 is already installed and coupled to the cooler. In other embodiments, however, the barrier 101 is added after market.

The barrier 101 can be located at any location where it serves as a barrier between the cooler contents and the outside air. Thus, the barrier 101 can be located on the side, top, or bottom of the cooler. In one embodiment wherein the user retrieves contents from the top, the barrier 101 is located above the contents in the cooler. In one embodiment, the barrier 101 is located below the cooler top.

As depicted and in one embodiment, located along the barrier 101 is a covered opening 103. The covered opening 103 comprises an opening along the barrier 101 which allows contents 102 to be placed or retrieved from the cooler 100 without removing the barrier 101. As shown, the covered opening 103 comprises a pliable material which does not act as a physical barrier. Because the material is pliable, a user can place their hand through the covered opening 103 to retrieve the cooler contents 102.

The covered opening 103, in one embodiment, serves as a physical impediment but not a barrier. Thus, the covered opening 103 slows air from passing either direction, but does not prohibit it like the physical barrier 101.

In one embodiment the covered opening 103 has a naturally closed position. Thus, in its normal state the covered opening 103 tends to be closed. However, when sufficient force is applied, the covered opening 103 can be opened.

In one embodiment the covered opening 103 comprises slits in a material. The material tends to be planar, but when force is applied, the opening 103 can open along the location of the slits. In other embodiments the covered opening 103 comprises plastic, rubber, etc. which is pliable.

The purpose of the covered opening 103 is to inhibit air and heat transfer while allowing contents to be placed or retrieved. If the covered opening 103 were simply an open hole rather than a covered opening 103, then the barrier 101 would still reduce heat transfer compared to prior art coolers, but the efficiency would likely be reduced due to the hole. The covered opening 103 allows contents to be placed and retrieved while maintaining the benefits of reduced heat transfer.

In one embodiment the covered opening 103 is secured and coupled to the barrier 101 via a coupler 104. As shown the coupler 104 comprises a backing 106 and screws 107 which attach to the barrier 101. This is for illustrative purposes only, however, and should not be deemed limiting. In one embodiment the barrier 101 comprises a hole, and the covered opening 103 is located adjacent said hole. This allows the permanent hole of the barrier 101 to be covered by a covered opening 103. In one embodiment the covered opening 103 has similar components to a Yoga mat in that it is flexible.

As noted, the size and specific dimensions would vary depending upon the application. In one embodiment the hole has a six inch diameter.

The placement of the covered opening 103 along the barrier 101 can be altered depending upon the desired application. As shown, the covered opening 103 is placed on an end of the cooler. In other embodiments the covered opening 103 is placed in the middle. Further, the covered opening 103 is depicted as being placed along the interior of the barrier 101, but in other embodiments the covered opening 103 is placed along the perimeter.

While one embodiment has been shown as having a single covered opening 103, this is for illustrative purposes only and should not be deemed limiting. In other embodiments the cooler will comprise two or more covered openings 103. Two or more covered openings 103 increase the surface area available for removing an item. Further, in large coolers, having a single opening may not be sufficient to allow the user to view and retrieve all of the contents. Still further, come coolers are segmented or portioned to provide separation within the cooler. Thus, rather than having one large void for the contents, the cooler has partitions to create two or more voids. In one embodiment each void comprises a covered opening 103 to allow access within that void.

Figure 2:
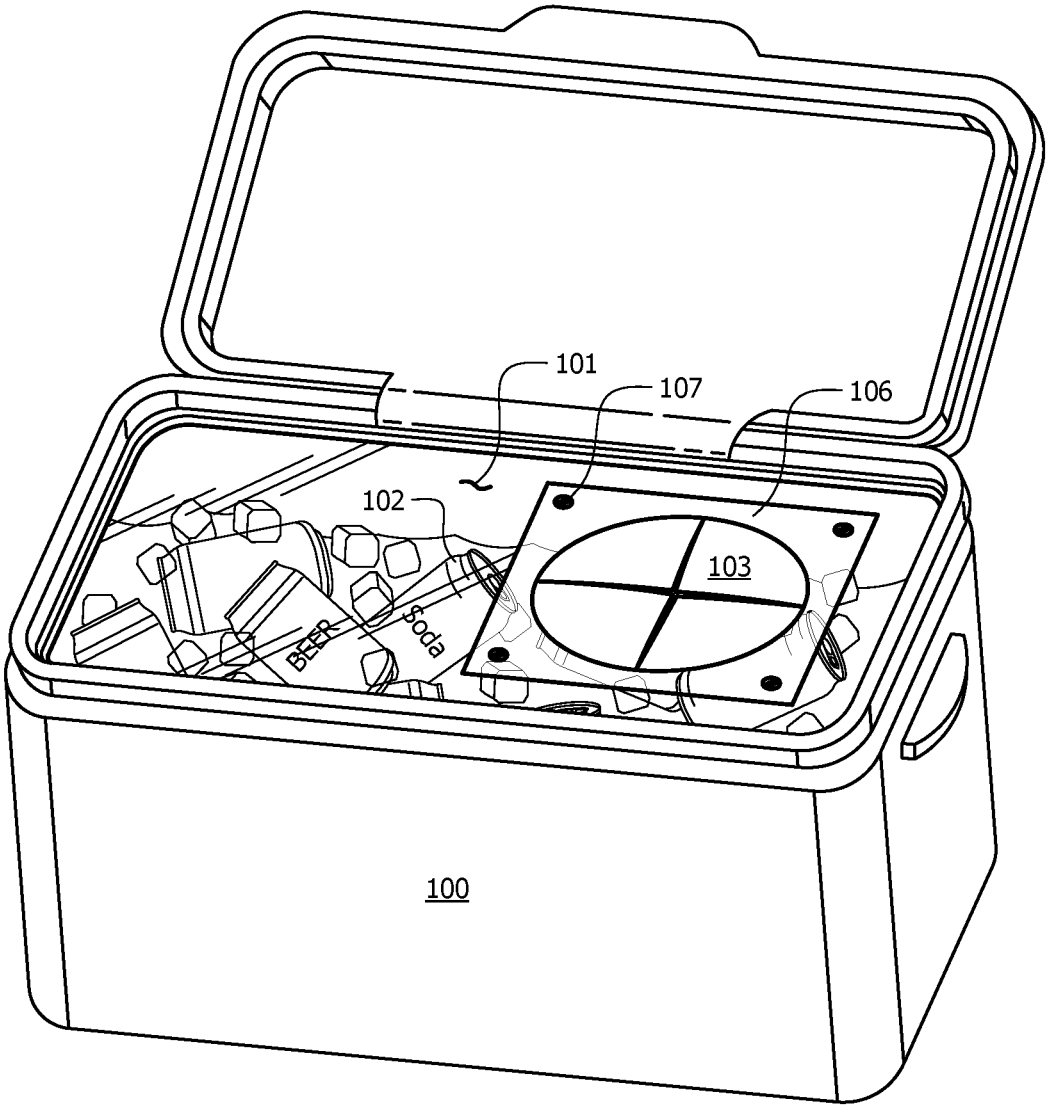
FIG. 2 perspective view of a cooler in one embodiment.

FIG. 2 perspective view of a cooler in one embodiment. As can be seen, the contents 102 are located below the barrier 101. It can be appreciated that a user can stick their hand through the covered opening 103 and retrieve contents 102 without exposing the entirety of the cooler contents 102 to outside air. Thus, the desired temperature and climate of the cooler void is disturbed as little as possible when retrieving contents. This allows the temperature of the cooler to be maintained for a longer period.

Figure 3:
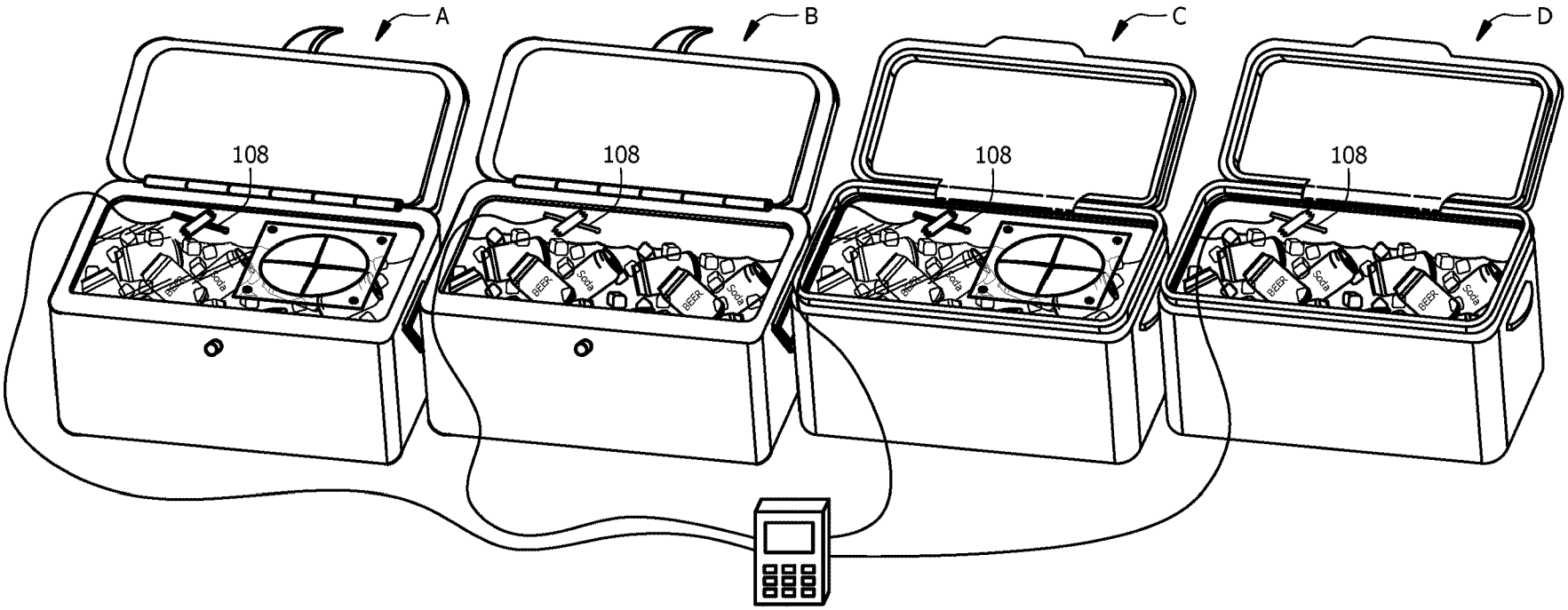
FIG. 3 is a comparison of coolers in one embodiment.

FIG. 3 is a comparison of coolers in one embodiment. Four coolers, A-D, each have a similar amount of contents 102. In this case, the contents 102 comprise beverage cans and ice.

Figure 4:
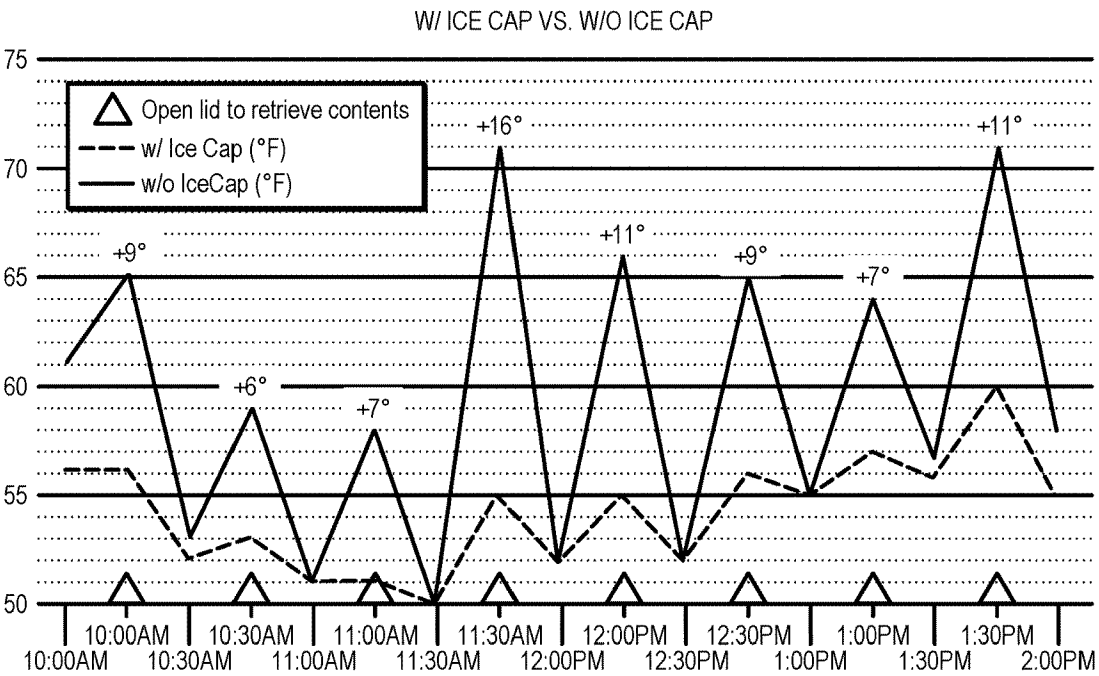
FIG. 4 is a chart and figure showing temperature changes in different coolers.

A thermocouple 108 is placed above the ice in each cooler. Coolers B, and D do not have a barrier 101, but coolers A and C has a barrier. The thermocouple 108 for Cooler C is placed below the barrier 101. FIG. 4 shows the temperature results for coolers A and B.

FIG. 4 shows the results of coolers A and B depicted in FIG. 3. Two identical coolers, each Yeti 50 quart coolers were each loaded with a case of beer and two 10 pound bags of ice each. The coolers were placed outside and in direct sunlight. Every 30 minutes, each cooler was opened, a beer was retrieved, and then the cooler lid was closed. The triangle shows the temperature change at the opening of each cooler. Thus, the triangle shows every time the cooler lid was open.

The top line shows the temperature of cooler B, whereas the bottom line shows the temperature of Cooler A over time. As can be seen, cooler B had a 9 degree temperature increase at the first opening whereas cooler A had a negligible change.

For cooler A, the cooler with the barrier, on average, the temperature jumped 2-5 degrees each time the cooler lid was opened. The cooler took on average about 2-3 minutes to return to temperature prior to the cooler being opened.

Turning to cooler B, the cooler without the barrier, this cooler, on average, jumped 7-11 degrees after opening and required about 10-15 minutes to return to the temperature prior to the cooler being opened. This means the cooler remained at an elevated temperature for 10-15 minutes after the cooler lid was opened. If there is a party where the cooler is opened more than every fifteen minutes, the cooler will never achieve the lower temperature. Accordingly, the contents will not reach or maintain the desired temperature.

As shown, a cooler with a barrier 101 is more efficient than coolers without such a barrier. The barrier 101 allows contents to be added and retrieved from the cooler without fear of introducing undesirable heat into the cooler. Considering that in certain embodiments, such as a party, the cooler will be constantly opened and closed as different guests gather drinks. This problem is compounded when the top is opened for minutes at a time to allow a user to sort through the ice, as an example, to locate the desired beverage. The barrier 101 allows all of the above functionality without sacrificing the temperature of the contents.

The barrier 101 can be added to existing coolers. In such embodiments the barriers 101 are sized to fit within an existing cooler. They are then coupled or adhered via any method or device known in the art. In other embodiments, however, the barrier 101 is integrated into the cooler when the cooler is manufactured.

While the coolers shown comprise a top, in other embodiments the coolers do not comprise a top. Instead, the barrier 101 functions as a top. In still other embodiments, and as shown, the coolers comprise both a top and a barrier 101, with each serving separate functions. In such embodiments the cooler top functions as other cooler tops, primarily serving as an insulating layer between the outside air and the cooler void. In operation, the cooler top is typically closed. When a user desires to retrieve contents from the cooler, the cooler top is opened. As noted this can be by removing the top entirely or by pivoting the open along a hinge. Thereafter, the user presses upon the covered opening 103 such that the user now has access to the cooler side of the barrier. The user selects the desired content and pulls the content through the covered opening 103. Thereafter, the top is closed. As noted, the process results in decreased cool air escaping the cooler and decreased hot air being introduced into the cooler.

As noted above, the system and method can be utilized on virtually any type, size, and shape of cooler. While a cooler has been described, this is for illustrative purposes only and should not be deemed limiting. The barrier and covered opening has benefits in other applications as well. As one example, the barrier and covered opening can be used as a topper for an item. The item can include, as an example, a bucket, a pail, etc. The barrier and covered opening is then used as a topper to keep the contents at the desired temperature—hot or cold.

Figure 5:
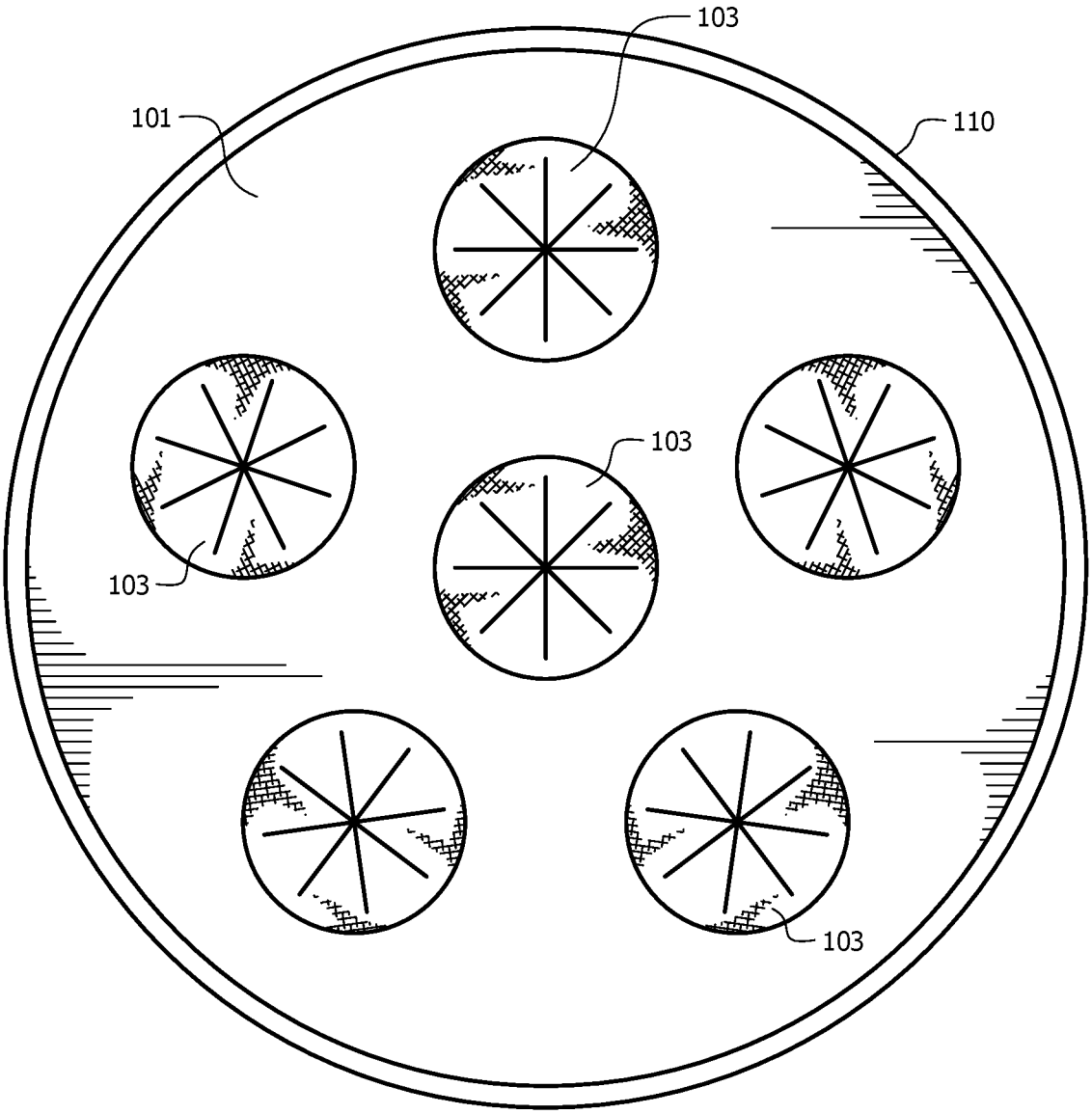
FIG. 5 is a top view of an embodiment utilized as a topper in one embodiment.

FIG. 5 is a top view of an embodiment utilized as a topper in one embodiment. As shown in FIG. 5, the topper comprises a barrier 101 as previously discussed. It also comprises a covered opening 103 as previously disclosed. Finally, the topper further comprises a coupler 110. The coupler 110 is used to couple the topper to an item such as a bucket. The coupler 110 can comprise any item which allows the topper to be releasably coupled. The coupler can couple via friction, for example. The coupler 110 can comprise bungee cords, a friction-fit lip, or the like to attach to the bucket.

Figure 6:
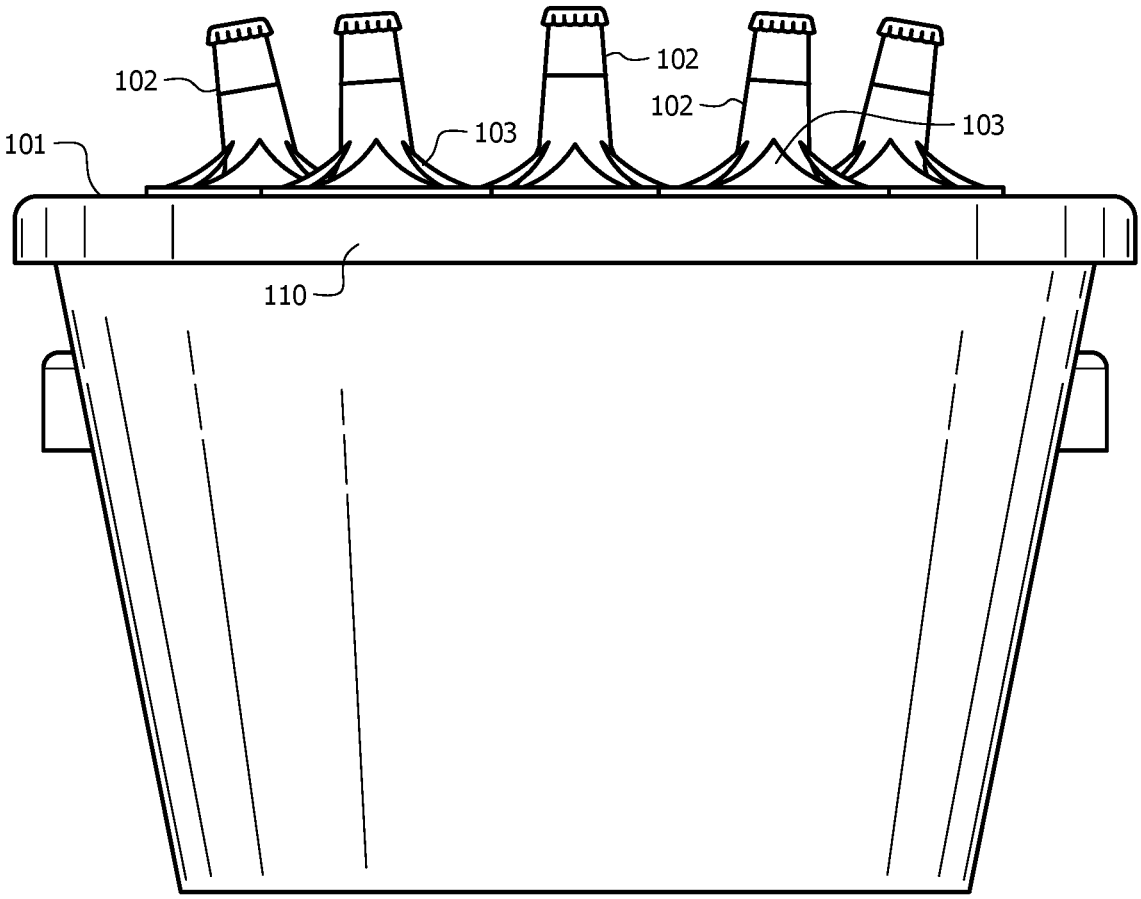
FIG. 6 is a perspective view of an embodiment utilized as a topper in one embodiment.

Turning to FIG. 6, FIG. 6 is a perspective view of an embodiment utilized as a topper in one embodiment. FIG. 6 shows the beer 102 extending partially through the topper, and specifically the barrier 101. The visible portion of the container 111 extends outward beyond the surface of the barrier 101. The barrier 101 will function as previously described and keep the contents of the bucket 109 at the desired temperature.

As shown, the contents 102 are extending through the covered opening 103 so that a portion is visible 111. In this manner, the bulk of the liquid is held and stored beneath the barrier 101. In one embodiment, the bucket 109 will be filled with contents 102, such as beer. The user will then fill the bucket 109 with ice. Often, because the bucket is open, the contents 102 are not as cool as desired. The topper discussed herein, can be used to keep the contents 102 cold. After the user has filled the bucket 109 with contents 102 and ice, the user couples the contents 102 to the bucket 109. The contents 102 are aligned to extend through the covered openings 103. Note, in other embodiments the topper can be coupled before the contents 102 are placed in the bucket. In one embodiment the covered openings 103 are sufficiently pliable to allow both the neck and base of the bottle to be pulled or placed through the covered openings. In this fashion, the barrier 101 and covered openings 103 act to prevent heat transfer between the outside air and the environment below the barrier 101, keeping the contents cooler for a longer period of time. The user no longer feels a rush to finish the bucket of beer before the bucket becomes warm. The size and dimensions of the topper can be adjusted depending upon the size of the bucket.

While the invention has been particularly shown and described with reference to a preferred embodiment, it will be understood by those skilled in the art that various changes in form and detail may be made therein without departing from the spirit and scope of the invention.

Additional Description

The following clauses are offered as further description of the disclosed invention.

Clause 1. A system for a cooler comprising:
a cooler comprising an internal void;
a barrier located within said internal void;
wherein said barrier comprises at least one covered opening.

Clause 2. The system of any proceeding or preceding claim further comprising a top, wherein said top is located above said barrier.

Clause 3. The system of any proceeding or preceding claim wherein said barrier is removeable.

Clause 4. The system of any proceeding or preceding claim wherein said barrier comprises a hinge.

Clause 5. The system of any proceeding or preceding claim wherein said barrier comprises a hole, and wherein said at least one covered opening is located adjacent to said hole.

Clause 6. The system of any proceeding or preceding claim wherein said covered opening comprises a pliable material.

Clause 7. The system of any proceeding or preceding claim wherein said covered opening comprises a naturally closed position.

Clause 8. The system of any proceeding or preceding claim wherein said covered opening comprises a material with at least one slit.

Clause 9. The system of any proceeding or preceding claim wherein said barrier comprises two covered openings.

Clause 10. The system of any proceeding or preceding claim wherein said barrier comprises an insulating material.

Clause 11. The system of any proceeding or preceding claim wherein said barrier comprises a seal along its perimeter.

Clause 12. The system of any proceeding or preceding claim further comprising a coupler to secure said at least one covered opening to said barrier.

Clause 13. The system of any proceeding or preceding claim wherein said coupler comprises a backing.

Clause 14. A system for a topper, said system comprising:
a barrier which comprises at least one covered opening;
a coupler coupled to said barrier.

Clause 15. The system of any proceeding or preceding claim further comprising a bucket located beneath said topper.

Clause 16. The system of any proceeding or preceding claim wherein said topper is circular, and wherein said coupler is located on the perimeter of said topper.

Clause 17. The system of any proceeding or preceding claim wherein said topper comprises at least five covered openings.

What is claimed is:

1. A system comprising:
a cooler to keep contents at a desired temperature;
the cooler comprising an internal central void;

a barrier located within said internal central void, and wherein said barrier is transparent;

wherein said barrier comprises at least one covered opening which opens to said central void;

wherein said cooler comprises the contents, wherein said contents are located entirely below said barrier, and wherein a user must reach through said covered opening to retrieve said contents located in said central void; and wherein said barrier comprises an insulating material.

2. The system of claim 1 further comprising a top, wherein said top is located above said barrier, and wherein said system comprises and wherein said central void comprises only one central void.

3. The system of claim 1 wherein said barrier is removeable, and further wherein said at least one covered opening comprises two covered openings, wherein each of said two covered opening opens to said internal central void.

4. The system of claim 3 wherein said barrier comprises a hinge.

5. The system of claim 1 wherein said barrier comprises a hole, and wherein said at least one covered opening is located adjacent to said hole.

6. The system of claim 1 wherein said covered opening comprises a pliable material, and wherein the user presses upon the covered opening to gain access to the internal void of the cooler and its contents, and wherein after the user selects the desired contents, the user pulls said contents through said covered opening.

7. The system of claim 1 wherein said covered opening comprises a naturally closed position.

8. The system of claim 1 wherein said covered opening comprises a material with at least one slit.

9. The system of claim 1 wherein said barrier comprises two covered openings.

10. The system of claim 1 wherein said barrier comprises a seal along a perimeter of said barrier.

11. The system of claim 1 wherein said covered opening comprises a backing, and further wherein said system comprises a coupler to secure said at least one covered opening to said barrier.

12. The system of claim 11 wherein said coupler comprises a backing.

13. A method of retrieving contents in a cooler, said cooler comprising:

an internal central void;

a barrier located within said internal void, wherein said barrier comprises a transparent insulated material wherein said barrier comprises at least one covered opening, and wherein said covered opening opens to said internal central void;

wherein said cooler comprises desired contents, and wherein said cooler keeps the desired contents at a desired temperature, wherein the entirety of said contents are located below said barrier, wherein said method comprising the steps of:

pressing upon the covered opening such that a user's hand has access to said internal central void;

selecting the desired contents;

pulling said desired contents from said covered opening.

14. The method of claim 13 wherein said cooler further comprises a top, and wherein said method comprises opening said cooler top prior to pressing upon the covered opening.

15. The method of claim 13 wherein said covered opening is pliable and which has a naturally closed position, and wherein said pressing causes space sufficient to receive a user's hand.

* * * * *